US007614332B2

(12) United States Patent
Pacione et al.

(10) Patent No.: US 7,614,332 B2
(45) Date of Patent: Nov. 10, 2009

(54) CARPET BEVELLER

(75) Inventors: John Anthony Pacione, Newmarket (CA); Hubert Schreimeier, Fohnsdorf Sillweg (AT)

(73) Assignee: Tac-Fast Georgia, LLC, Atlanta, GA (US)

( * ) Notice: Subject to any disclaimer, the term of this patent is extended or adjusted under 35 U.S.C. 154(b) by 0 days.

(21) Appl. No.: 10/690,512

(22) Filed: Oct. 23, 2003

(65) Prior Publication Data

US 2005/0087052 A1 Apr. 28, 2005

(51) Int. Cl.
*B26D 3/00* (2006.01)

(52) U.S. Cl. ..... 83/869; 83/349

(58) Field of Classification Search ..... 83/869, 83/673, 341, 349, 500–503, 505, 506, 508, 83/508.2; 26/15 R, 8 C; 409/138; 407/53, 407/61

See application file for complete search history.

(56) References Cited

U.S. PATENT DOCUMENTS 3,084,582 A * 4/1963 Anderson ..... 83/341
3,353,754 A * 11/1967 Heijnis et. al. ..... 241/30
3,760,673 A * 9/1973 Peterson, Jr. ..... 83/349
3,769,666 A * 11/1973 Kaufman ..... 26/15 R
4,030,394 A 6/1977 Kistner et al.
4,074,390 A 2/1978 Meyn
4,109,352 A 8/1978 Buthe
4,130,048 A * 12/1978 Lewallyn ..... 409/158
4,207,726 A 6/1980 Lippl
4,484,505 A * 11/1984 Lewallyn ..... 83/869
5,285,558 A 2/1994 Carder et al.
5,365,821 A 11/1994 Munier et al.
5,832,802 A 11/1998 Warthen et al.
5,979,278 A 11/1999 Warthen et al.
2002/0071930 A1 6/2002 Oakey et al.

FOREIGN PATENT DOCUMENTS

EP 0 891 703 A1 1/1999

OTHER PUBLICATIONS

National Flooring Equipment, "Flooring Tools & Equipment", 2002, National Carpet Equipment, Inc.

* cited by examiner

*Primary Examiner*—Stephen Choi
(74) *Attorney, Agent, or Firm*—Ogilvy Renault LLP; Brian W. Gray; Christopher Hunter

(57) ABSTRACT

This invention relates to a beveller for a carpet. The beveller includes a rotatable blade for cutting material. The blade is mounted about an axis of rotation and has an edge which is non-linear radially. The beveller also includes a counter-knife having an edge mounted adjacent to the blade. The counter-knife edge generally conforms to a profile of the blade edge to permit the blade edge to pass adjacent the counter-knife edge, as the blade rotates, to shear material placed between the blade edge and the counter-knife edge.

13 Claims, 8 Drawing Sheets

CARPET BEVELLER

FIELD OF THE INVENTION

This invention relates to the field of carpet pile removers. In particular, it relates to carpet pile removers having rotating cutting blades and co-operating counter knives.

BACKGROUND OF THE INVENTION

Rotational carpet bevellers are commercially available. For example, National Carpet Equipment, Inc. of Minneapolis, Minn. manufactures bevellers used in the carpet industry. Carpet bevellers are typically used to remove pile from carpet edges. When pieces of bevelled carpet are placed adjacent one another, this bevelling can produce visually pleasing textural effects due to different light reflectivity at the "troughs" of abutted bevelled pieces. Depending on factors such as the texture of the carpet or ambient lighting, such effects may not always be apparent.

Rotational carpet bevellers often include a rotating cutter and a stationary, opposed, counter-knife, these two parts defining blades that co-operate to cut the pile of the carpet. The rotating cutter has a cutting edge that is formed to meet the counter-knife at an angle so as to produce a shearing action along the blades. The edge of the cutter is formed to sweep out a body of revolution, with the edge of the cutter then lying on the body of revolution so defined. By way of example, for a circular cylindrical body of revolution, the cutting edge may trace out a portion of a helix.

When adjacent one another, the cutting edge and counter-knife appear to form a closed, or acute, angle. As the cutter rotates, its cutting edge passes the counter-knife. When the counter-knife is viewed in plan view, an end of the rotating cutting edge first passes a corresponding end of counter-knife. As the cutter further rotates, the remaining end of the cutting edge passes the remaining end of the counter-knife. Cutting takes place at the point at which the cutting edge passes the counter-knife. If the cutting edge is partially along the surface of an imaginary cylinder, as in the form of a helix, then the cutting point moves from one end of the counter-knife to the other as the cutting edge passes the counter-knife. This moving point traces what is called a cutting line. The cutting line is often substantially parallel to the axis of rotation of the cutter.

Any carpet pile placed between the edges of the cutting edge and counter-knife is cut in a shearing action along the cutting line as the cutting edge passes the counter-knife. In a typical prior installation, the carpet pile is cut in a generally downward motion starting at the free ends of the pile, and moving towards the carpet base.

Rotational carpet bevellers typically have an axis of rotation (and cutting line) that forms an angle, either a right angle or an acute angle, with the surface of the carpet piece to be bevelled. A cutting area of the beveller is exposed to engage an edge of a carpet piece. The beveller is usually stationary with respect to the carpet piece. The carpet piece, lying substantially in the horizontal plane, is positioned relative to the cutting area so that, when the carpet piece is moved horizontally past the cutting area, the edge of the carpet piece encounters the cutting line and is bevelled at the angle of the straight cutting line.

The carpet edge is guided relative to the cutting area by a fence. The fence may be an adjustable guidance bar, which maintains the carpet edge at a desired distance from the cutting line as the carpet edge is moved horizontally past the cutting line along the fence.

The cutting line can be tilted through various angles to engage more or less of the pile element. The cutting line can be viewed as the hypotenuse of the right angled triangular section of pile which is removed. This right angle is formed by the pre-bevelled, vertical tuft row at the carpet edge and the horizontal plane of the carpet surface.

Conventional rotational bevellers have a straight cutting line and therefore transpose a straight-angled cut to a carpet edge. Even a single straight edge may not be well made by conventional bevellers because of the need for a clean vertical edge at the base of the carpet as will be described below. A pillow effect where there is a convex arc or rounded edge to the carpet can be achieved by multiple straight edged bevellers in line, or by multiple passes through the same beveller where there have been adjustments of the tilt axis or angle of the cutting line in co-operation with distance positioning of the carpet edge via the fence. Of course any number of straight edged bevellers in line could not achieve a concave edge.

It is desirable, but not essential, that a bevelled carpet edge exhibits the following features:

i) Clean Edge for Precision Abutment of Like Pieces:

It is generally desirable to create a clean bevelled carpet edge for precision abutment of like carpet pieces. Carpet pile is preferably oriented generally at right angles to the base of the carpet. Since carpet tuft elements are flexible, they sometimes lean from a vertical orientation. This is particularly true of rolled carpets. To bevel a carpet piece when there are leaning tufts, the edge of the carpet piece is preferably pre-cut using a cutting line angle that is substantially perpendicular to the plane of the carpet base. This pre-cut is not necessarily intended to bevel the carpet edge. It is intended to remove the ends of leaning tufts to make a clean carpet edge in preparation for bevelling.

If the carpet is bevelled before cleaning the carpet edge, leaning tufts are not generally removed effectively. When like carpet pieces are abutted, the leaning tufts can make a buffer zone (see next heading) look uneven. Leaning tufts may also make it difficult to cause adjacent carpet pieces to abut one another. Using a two-step bevelling operation, the edge is first cleaned in a cleaning pass of the carpet edge, and in a second step, the carpet is bevelled.

ii) Vertical Tuft Buffer Zone of Abutted Carpet Pieces

The bevel portion of a carpet piece is typically cut so that there is a small remaining vertical tuft element along the edge of the carpet piece. When like carpet pieces are abutted, this vertical element at abutting carpet edges forms a buffer zone which is intended to mesh sufficiently with adjacent buffer zones to mask the discontinuity of assembled carpet pieces. Without this vertical element, abutting carpet pieces can appear to be separate elements, rather than a visually pleasing single carpet, having a bevelled design.

To achieve an adequate buffer zone at the carpet edge, the fence is adjusted to encourage upper portions of the cutting line to intersect upper portions of pile element, while lower potions of the cutting line are distanced from the base of the carpet to leave lower portions of the pile element remaining to form the buffer zone. While this succeeds in leaving a sufficient vertical length of tuft element at the edge of the carpet piece, unless the carpet piece has been first run through a vertical cutter, the remaining tuft elements are often left leaning, frayed or unevenly cut. This occurs because after cutting, some of the tuft elements also extend beyond the cutting line, leaving a somewhat uneven edge. This uneven edge can lead to a visually displeasing buffer zone. Without this vertical element, abutting carpet pieces can appear to be separate elements, rather in a visually pleasing single-carpet having a bevelled design.

iii) Stylized Edge Design

It is often desirable to have pile removal at carpet edges to cause visual effects caused by different light reflectivity at the "troughs" of abutted bevelled carpet pieces. The ability to create different light effects is in part limited by the angle of the cutting line relative to the carpet base. A straight edge beveller can change the bevelled look by changing the angle of the beveller, however, there are advantages to creating a more rounded or "pillowed" bevelled look.

Attempts have been made to "pillow" the carpet edge. Pillowing is rounded or radiused edges rather than the straight bevel lines described above. Pillowing is generally achieved by mounting in series five or more bevellers with each beveller set at a slightly different cutting angle to define a section of a polygon. The multiple bevellers thus co-operate to produce a visually radiused carpet edge in the shape of the polygon section. Each side of the polygon is cut by a respective beveller, and each side is preferably short enough that the combined cut sides appear to form a generally rounded or "pillowed" edge. The pillowed edge can be difficult to achieve because all the bevellers must be precisely angled and positioned, and the carpet must be guided precisely past the blades of all of the bevellers. In addition, multiple bevellers must be used to create just one edge, which can increase equipment and maintenance costs.

Accordingly, there is a need for alternative bevellers for carpets.

SUMMARY OF THE INVENTION

In accordance with a broad aspect of the present invention there is provided a beveller for a carpet. The beveller includes a rotatable blade for cutting material. The blade is mounted about an axis of rotation and has an edge which is non-linear radially. The beveller also includes a counter-knife which has an edge mounted adjacent to the blade. The counter-knife edge generally conforms to a profile of the blade edge to permit the blade edge to pass adjacent the counter-knife edge, as the blade rotates, to shear material placed between the blade edge and the counter-knife edge.

In an embodiment the counter-knife edge and blade edge form an acute cutting angle therebetween when the blade is rotated relative to the counter-knife. The apex of the acute cutting angle moves along the counter-knife edge as the blade is rotated to shear material placed adjacent the apex.

In a further embodiment the blade edge is located along the surface of an imaginary cylinder formed by the rotation of the cutting edge, so that the cutting edge of the rotating blade passes the cutting edge of the counter-knife in succession when the rotating blade is turned.

In a yet further embodiment a portion of the blade edge first rotates past the counter-knife to cut a portion of the carpet pile adjacent a base of the carpet first.

In other embodiments the counter-knife edge is parallel to the axis of rotation. The blade edge may also have at least one curved portion. The blade edge may include a portion for cleaning an edge of the carpet and the counter-knife includes an edge that generally conforms to a profile of the cleaning portion of the blade edge. The blade edge may also have at least one straight portion, and/or at least one cusped portion.

In accordance with another broad aspect of the invention, there is provided a beveller for a carpet having a rotatable blade. The blade has a cutting edge moveable about a first axis of rotation. The cutting edge is differentially radially spaced from the axis of rotation and traces as it rotates a cutting boundary radially spaced from the axis of rotation. The beveller also includes a counter-knife which has a cutting edge that conforms radially to the shape of the rotating blade. The counter-knife is placed so as to come into adjacent cutting relation at a point or points equidistant from the cutting boundary traced by the rotating blade.

In an embodiment the counter-knife and rotatable blade come into cutting relation sequentially axially as the rotatable blade traces the cutting boundary.

In a further embodiment, the counter-knife and the cutting edge of the rotatable blade are oriented in respect of a carpet edge so that they come into cutting relation to cut the carpet edge at a point sequentially from a base of the carpet to free ends of tuffs of the carpet.

In a yet further embodiment the blade is shaped so that it traces a cutting boundary which cuts a first portion which is substantially perpendicular to the plane of the carpet base and a second portion which is at an angle relative to the plane of the carpet base.

Other and further advantages and features of the invention will be apparent to those skilled in the art from the following detailed description of embodiments thereof, taken in conjunction with the accompanying drawings.

BRIEF DESCRIPTION OF THE DRAWINGS

The present invention will be further understood from the following detailed description of embodiments of the invention, with reference to the drawings in which.

DETAILED DESCRIPTION OF EXEMPLARY EMBODIMENTS

Figure 1:
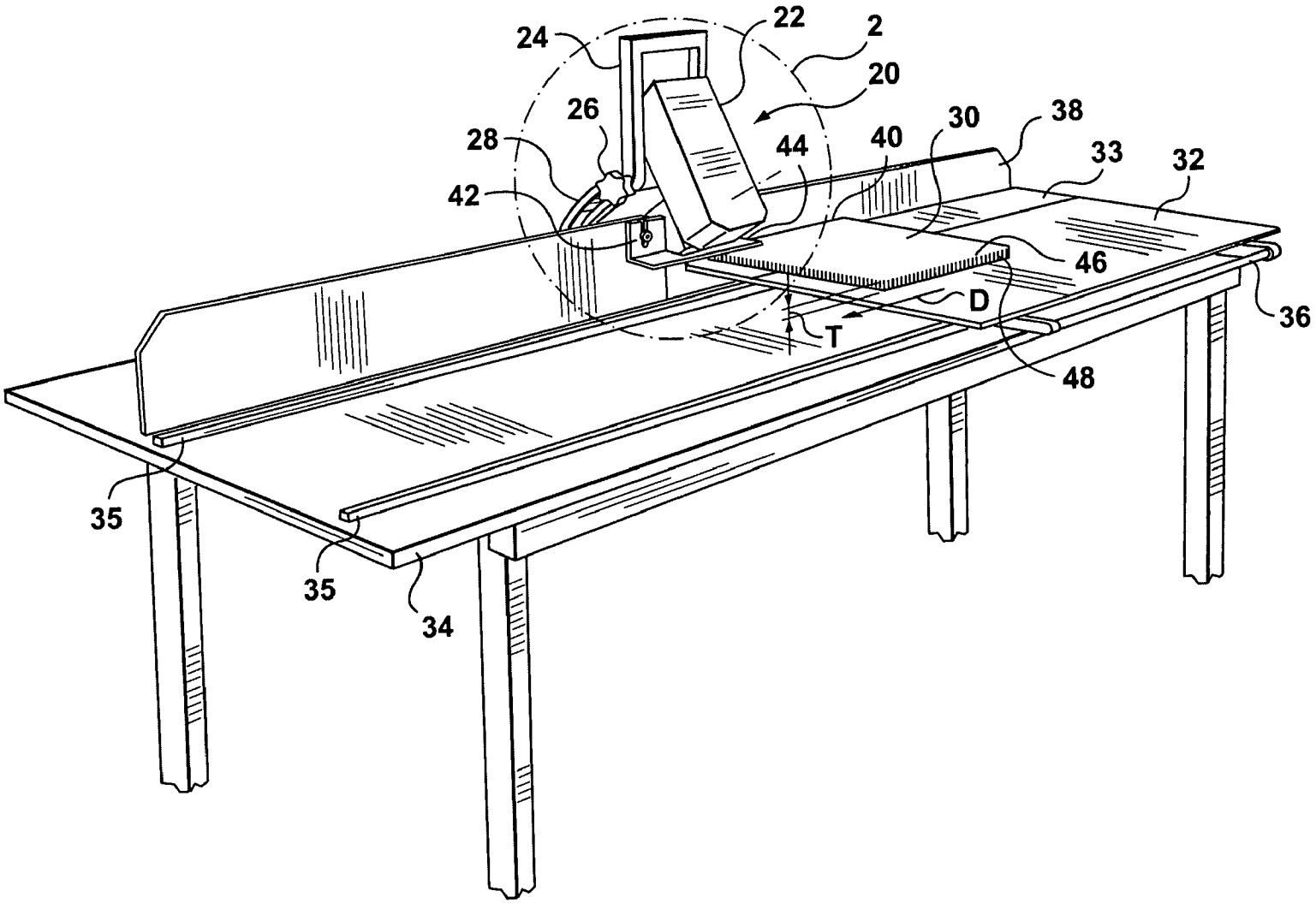
FIG. 1 is perspective view of a beveller and table assembly according to an embodiment of the present invention.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

In terms of general orientation and directional nomenclature, it is assumed that the apparatus of the present invention is used in connection with a substantially planar floor covering material, such as a pile carpet. In that regard, a cartesian co-ordinate system of x, y, and z mutually perpendicular axes may be defined in which the base of the floor covering can be defined as lying in an x-y plane. In operation, the cutting apparatus of the present description advances along an edge of the floor covering. For the purposes of this description, the edge will be taken as being linear, and extending in the x direction, such that the direction of feed of the cutting apparatus is in the x direction. The through thickness depth of the floor covering material extends generally upwardly from the base, namely in the vertical, or z, direction. That is to say, where the floor covering is a pile carpet, the pile stands upward, namely in the z-direction.

The cutting apparatus may include a rotor, or rotating cutting member, that meets a stator, or stationary cutting member, to co-operatively produce a cutting action. During operation, the stator, or counter knife, is mounted in a static relationship to the rotating cutting member, and is mounted such that relative motion between the flooring material and the fence, or guide, of the cutting apparatus, and, in particular, the counter-knife, occurs in the linear, or x-direction, to produce a cut along the edge of the floor covering material. The rotor, or rotating cutter, is rotatably mounted on a shaft having an axis of rotation. The axis of rotation is fixed relative to the position of the counter knife, such that relative motion between the edge of the flooring material and the counter-knife in the x-direction will be accompanied by similar relative motion of the axis of rotation of the cutting axis with respect to the edge of the flooring material to be cut. In one embodiment, the counter-knife may tend to lie in a vertical plane. The axis of rotation of the cutting apparatus may tend to lie in the same vertical plane. That plane, which may be designated the "cutting plane" may tend to be a y-z plane, namely a vertical plane extending perpendicular to the direction of feed (namely the x-direction) of the flooring material relative to the cutting apparatus. The axis of rotation of the cutting apparatus in that plane intersects the y-axis at an azimuth angle, or angle of elevation with respect to the horizontal, the azimuth angle being 90 degrees or less.

Referring to FIG. 1, a beveller assembly 20 and a table assembly according to an embodiment of the present invention are shown. Beveller assembly 20 is used to bevel an edge of a carpet piece 30, while at the same time cleaning the carpet edge of leaning and other misaligned carpet tufts. The cleaning of the carpet edge can facilitate precision abutment of like carpet pieces to attempt to provide a more visually pleasing surface covering.

Beveller assembly 20 may also be used to create bevels having many different profiles. For example, profiles composed of one or more generally straight edges may be cut using beveller assembly 20 (see for example FIG. 3F). Other configurations of beveller assembly 20 may be used to cut bevels having curved, radiused, cusped or other non-linear shapes (see FIG. 3B, for example). Alternatively, beveller assembly 20 may be configured to cut a bevel having a profile made up of a combination of one or more straight sections and curved sections. In each case, bevels are made using a single beveller assembly, making a single cutting pass along carpet piece 30. Beveller assembly 20 achieves this single pass bevelling using a rotatable cutter that co-operates with a counter knife having a similar profile to the cutter. These and other features are described in further detail below.

Beveller assembly 20 has a housing 22 and is mounted to a rack 24. Adjustment of beveller assembly 20 may be made using an adjustment assembly such as knob 26 and co-operating mount 28. Alternatively, beveller assembly 20 may be permanently mounted in a desired orientation, without the inclusion of an adjustment assembly.

Beveller assembly 20 is mounted so that it may be positioned to engage and bevel carpet piece 30. Carpet piece 30 is placed onto a moveable assembly in the nature of a trolley 32. Carpet piece 30 is preferably attached to trolley 32 using a retainer 33. Retainer 33 may be a hooked surface for co-operatively engaging a looped surface on the underside of carpet piece 30 (not shown). Carpet piece 30 may alternatively be attached to trolley 32 in some other manner, such as using a releasable glue or clips.

Trolley 32 is moveably, and preferably slideably, mounted to a table 34. Table 34 has a surface that is about two metres long by about one metre wide. Larger and smaller tables may also be used. One or more rails 35 are placed intermediate trolley 32 and table 34 to enable sliding of trolley 32 relative to table 34 in direction D. Trolley 32 may be moved using an automated system, or it may be moved manually, for example, using handle 36. In an alternative embodiment, trolley 32 and table 34 may be replaced with a conveyor system (not shown) for automated bevelling of carpets. Accordingly, beveller assembly 20 may be located in numerous configurations with respect to moving mechanisms and supports such as table 34 (and, if used, trolley 32) to bevel carpets.

As shown in FIG. 1, a fence 38 abuts a side of trolley 32 and serves to position the carpet. Fence 38 further serves to guide an edge 40 of carpet piece 30 into alignment with beveller assembly 20 so that edge 40 may be bevelled. A shield 42 is mounted about an end of beveller assembly 20 to inhibit hands and other objects from coming into contact with the cutting portion of beveller assembly 20. Shield 42 is preferably mounted to be spaced from trolley 32 by a distance slightly smaller than a thickness T of carpet piece 30. Alternatively, shield 42 may be omitted.

As carpet piece 30 is moved towards beveller assembly 20, along fence 38, a leading edge 44 of shield 42 abuts free ends 46 of carpet tufts 48. Free ends 46 bend slightly as they are moved under shield 42. This action may encourage the alignment and straightening of carpet tufts 48 prior to the cutting of free end 46 by beveller assembly 20, but its main purpose is to shield the cutter. As edge 40 is moved towards beveller assembly 20, it is progressively bevelled by beveller assembly 20 in a single pass. Carpet piece 30 may be further bevelled by removing carpet piece 30 from trolley 32 and replacing carpet piece 30 with a different edge thereof placed adjacent fence 38. Trolley 32, with re-oriented carpet piece 30, may then be moved in direction D towards beveller assembly 20 to be cut in the same manner as described above. This process may be repeated for each side of carpet piece 30, or for additional carpet pieces.

In an alternative embodiment (not shown), carpet piece 30 may be stationary, and beveller assembly 20 may be moved relative to carpet piece 30 to bevel portions thereof. For example, beveller assembly 20 may be slid manually, or using an automated arrangement, along a rail or other structure, to bevel an edge of carpet piece 30. It is also possible to make both beveller assembly 20 and carpet piece 30 movable.

Figure 2:
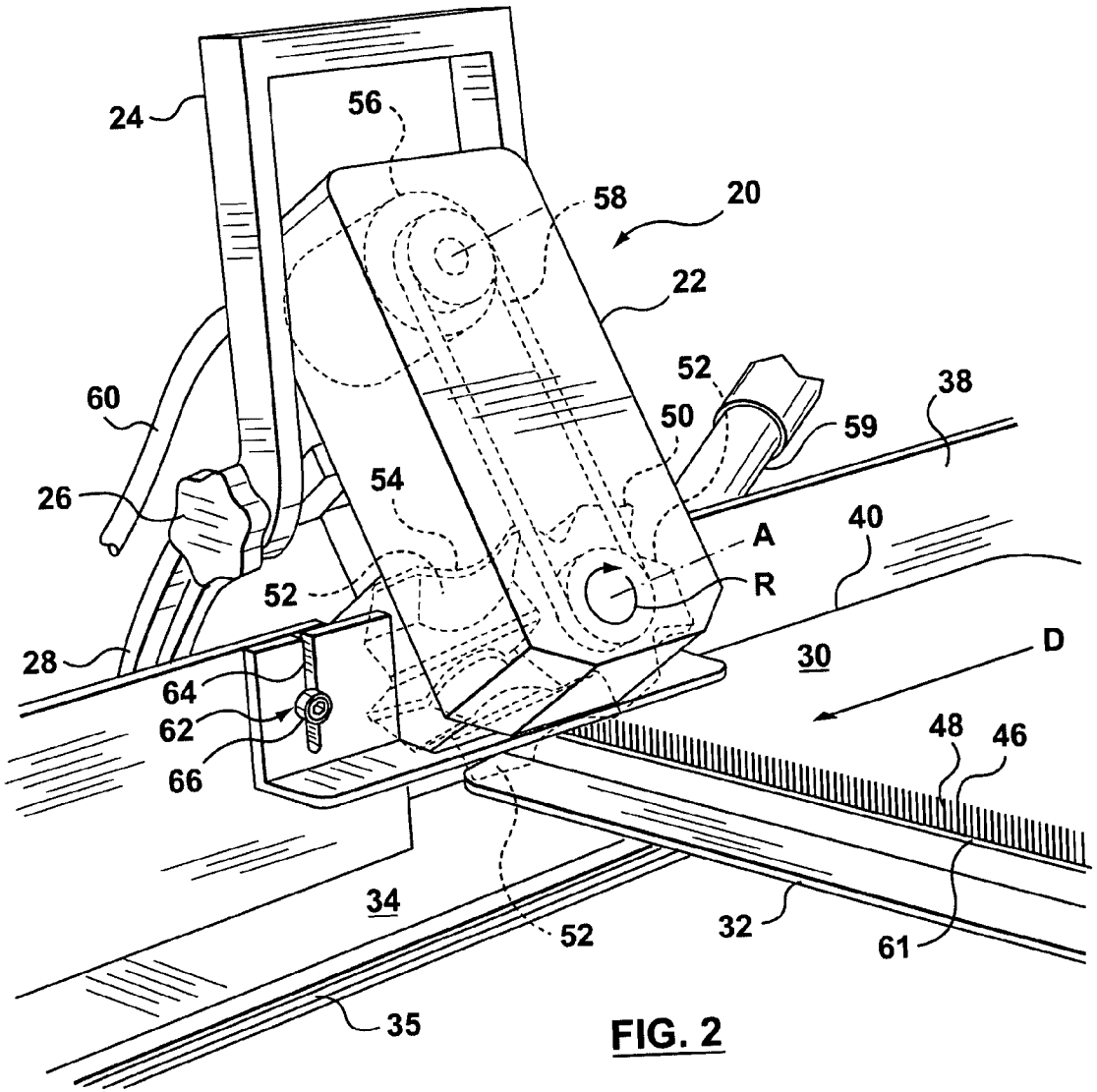
FIG. 2 is a perspective view of the beveller of FIG. 1 with a cutter and drive assembly shown in phantom.

Referring to FIG. 2, details of the beveller assembly 20 are shown. Beveller assembly 20 has a rotatable cutter 50 for bevelling portions of carpet piece 30. Cutter 50 and other parts of beveller assembly 20 are protected by a housing 22, and are not usually seen when beveller assembly 20 is in operation. (Accordingly, cutter 50 and other components of beveller assembly 20 are shown in stippled lines in FIG. 2.) Of course, one or more portions of housing 22 may be omitted. If this is done, cutter 50 may become dangerously exposed.

Cutter 50 is rotatable in direction R about axis A. Cutter 50 may be rotated by a direct drive motor, or some other arrangement such as a drive pulley assembly which includes electric motor 56 and tensioned band 58. The transmission ratio of the pulleys is preferably about 4:1. Electric motor 56 is powered by a power supply 60 which permits motor 56 to drive tensioned band 58, which in turn rotates cutter 50 at high speed. Cutter 50 is preferably rotated at between 500 and 20,000 revolutions per minute, but other rates may also be appropriate. The cutter, in the embodiment shown, is rotating at about 2500 rpm from a motor rotating at 10,000 rpm at a 4:1 gear ratio. A vacuum outlet 59 may optionally be provided in housing 22 and connected to a vacuum to draw cut material and other debris away from cutter 50. The basic components of beveller assembly 20, such as electric motor 56 and tensioned band 58, may be obtained from a company such as N-C Carpet Binder & Equipment Corp., 858 Summer Avenue, Newark, N.J. 07104 USA.

Cutter 50 has at least one blade 52, and preferably has five equally spaced radiating blades 52, extending generally axially along cutter 50. Of course, fewer or more blades may be employed, and they may be unevenly spaced as long as the functioning of beveller assembly 20 is not significantly impaired. Each blade 52 has a cutting edge 54 for cutting carpet tufts (or pile) 48. Beveller assembly 20 is positioned relative to carpet 30 so that the axis of rotation A of cutter 50 forms an acute angle with a base 61 of carpet 30. Axis A may also be oriented normal to carpet base 61, depending on the type of bevel or cleaning of carpet edge 40 required. Cuffing edges 54 are thus oriented to engage carpet tufts 48 along an edge 40 of carpet 30.

As noted above, fence 38 helps to guide carpet edge 40 so that edge 40 engages blades 52 while carpet 30 is moved in a direction generally normal to the access of rotation A. The positioning of carpet 30 relative to cutter 50 may be adjusted in a number ways, and is not limited to the adjustments described herein. For example, the height of trolley 32 may be adjusted by changing the height of rails 35. This adjustment could be used to affect the depth of the cut of carpet tufts 48. Fence 38 could also be used to adjust the relative positioning of carpet piece 30. For example, fence 38 could be mounted so that carpet piece 30 is positioned in a location horizontally displaced from the location shown in FIG. 2, in a direction generally away from beveller assembly 20. In this modified position (not shown), a smaller proportion of each carpet tuft 48 will be removed, resulting in a smaller bevel being made to carpet edge 40. In such case, edge 40 might not be "cleaned" in the manner described below. Nevertheless, at least a partial bevel of edge 40 may still be obtained. Alternatively, the cutting angle of cutter 50 relative to carpet base 61 may be adjusted using the mounting assembly, which includes knob 26 and mount 28. These and other adjustment mechanisms may be used to vary the relative positioning of cutter 50 to carpet piece 30 in order to change the nature and extent of any bevel made to carpet edge 40.

As shown in FIG. 2, to enable various thicknesses T of carpet 30 to be used, a shield adjustment apparatus 62, may be employed. Shield adjustment apparatus 62 may include at least one slot 64 which engages at least one tightenable retainer 66 in the nature of a bolt. By loosening retainer 66, shield 42 may be slid along slot 64 to change the position of shield 42. Retainer 66 may then be tightened to secure shield 42 in place.

Figure 3:
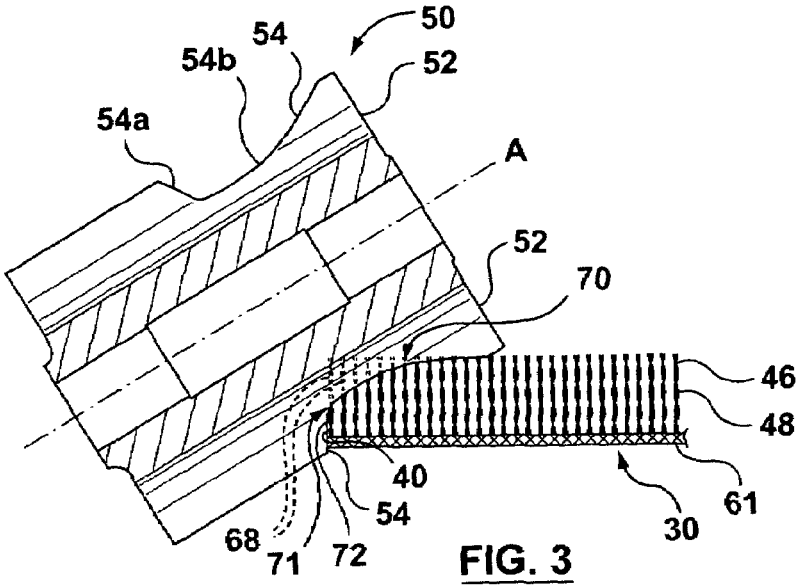
FIG. 3 is an isolated cross-sectional view of the cutter of FIG. 2 oriented to cut carpets.
Figure 6:
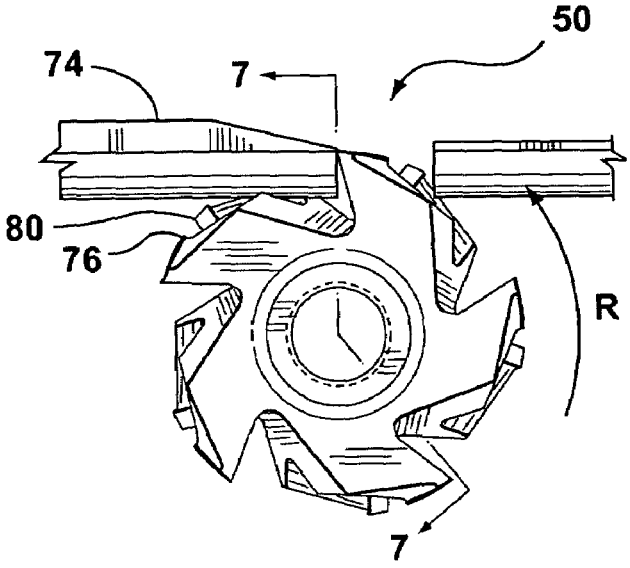
FIG. 6 shows an isolated bottom view of the cutter of FIG. 2.

Referring to FIG. 3, cutter 50 is shown in isolation and cross-section (taken along line 7-7 of FIG. 6). Carpet 30 is also shown with cut tufts 68 shown in stippled lines.

The cross-sectioned shape of blade cutting edge 54 generally defines the shape of the resulting bevel 70 in carpet 30. Cutting edge 54 preferably has at least two portions which perform related functions. A first portion 54*a* cleans edge 40 of leaning and other misaligned carpet tufts (not shown). Axis A of cutter 50 is preferably angled from vertical so that cleaning portion 54*a* is generally perpendicular to carpet base 61 at a cutting location, when cleaning portion 54*a* is viewed in cross-section. In the present embodiment, cleaning portion 54*a* is generally perpendicular to carpet base 61 when axis A is angled by approximately 30 degrees from vertical. Beveller assembly 20 may be secured in this position without further adjustment.

In the present configuration, carpet tufts that extend beyond edge 40 are removed to the extent that they extend beyond edge 40. Cleaning of carpet edge 40 permits similarly cleaned carpet pieces to be brought into abutting arrangement. Visual discontinuity caused by leaning or misaligned carpet tufts is generally reduced.

Cleaning portion 54*a* may alternatively be oriented at some other angle relative to carpet base 61 to provide a bevel originating at base 61, but this is not usually the intended function of cleaning portion 54*a*. Such an arrangement may reduce or eliminate any buffer zone. While this is not preferred, it may be an appropriate result for some purposes.

A visually smooth integration of like carpet pieces may be further facilitated by creating a buffer zone 71 along edge 40. Buffer zone 71 is defined by a small remaining vertical tufted element 72 along the edge 40 after carpet piece 30 is bevelled. When like carpet pieces are abutted, this vertical tufted element 72 forms buffer zone 71 which is intended to mesh sufficiently with a buffer zone of an adjacent carpet piece to mask the discontinuity of the assembled carpet pieces. Without this vertical element 72, abutting carpet pieces can appear to be separate elements, rather than a visually pleasing single carpet.

A second portion of cutting edge 54, labelled 54*b*, bevels edge 40. Buffer zone 71 is cut in the general area of cutting edge 54 that edge portions 54*a* and 54*b* meet. The length and extent of the carpet tufts forming buffer zone 71 are affected by the dimensions and positioning of cutting edge 54. Accordingly, edge portions 54*a* and 54*b* may be configured to be longer or shorter, or have a different profile than shown, depending on the desired cut dimensions of carpet tufts 72 forming the buffer zone 71. In an embodiment of the invention, edge portion 54*a* is longer than the length of uncut carpet tufts 48.

In the embodiment described thus far, beveller assembly 20 both cleans carpet edge 40 using cutting edge portion 54*a* and cuts a buffer zone 71 at vertical element 72 using cutting edge portions 54*a* and 54*b*. This is done using a single pass along carpet edge 40 by a single beveller assembly 20.

At the same time that edge 40 is cleaned and buffer zone 71 is created, carpet edge 40 may also be bevelled. This may be achieved by the bevel creating portion 54*b* of cutting edge 54. As shown in FIG. 3, bevel portion 54*b* is generally rounded to produce a radiused or pillow cut of carpet edge 40. Bevel portion 54*b* may alternatively be configured to produce a generally linear bevel (see FIG. 3F, for example) similar to that made by prior art carpet bevellers. However, unlike bevellers of the prior art, the beveller of the present embodiment bevels, cleans, and creates a buffer zone in a single pass using a single beveller assembly.

Alternative embodiments of the invention may include only a bevel creating portion 54*b*, without a cleaning portion 54*a*.

Figure 3A:
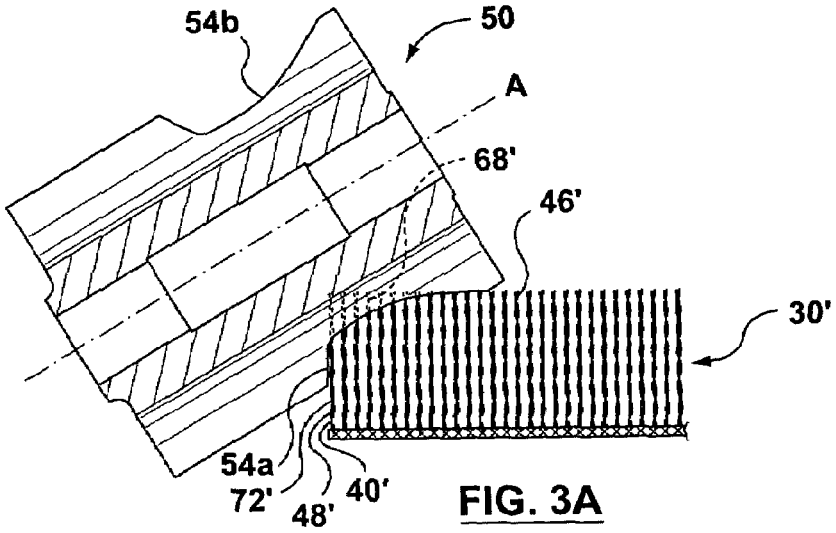
FIG. 3A shows the cutter of FIG. 3 bevelling a carpet having longer tufts than the carpet of FIG. 3.

Referring to FIG. 3A, cutter 50 is shown bevelling a carpet 30' having longer carpet tufts 48' to remove tuft portions 68'. While the cut tuft portions 68' are similar to those shown in FIG. 3, the remaining portions of tufts 48' are longer. In this example, clean cut portion 54*a* of cutting edge 54 is shorter than vertical tuft element 72'. Accordingly, there is limited cleaning of edge 40' by cutting edge portion 54*a*.

Figure 3B:
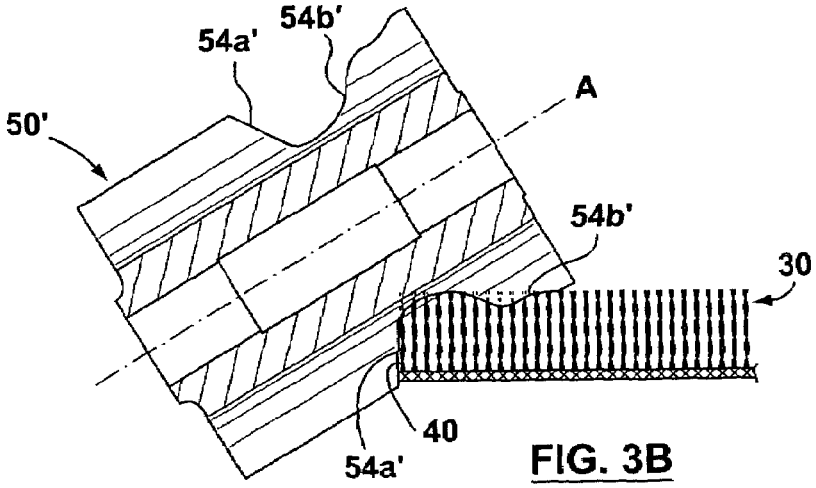
FIG. 3B shows an alternative embodiment of the cutter of FIG. 3 showing the cutter having a different blade profile.
Figure 3C:
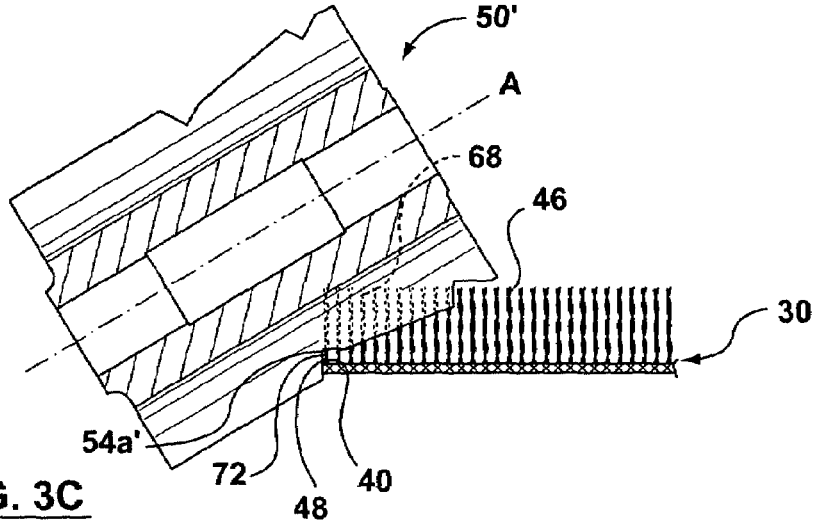
FIG. 3C shows a further alternative embodiment of the cutter of FIG. 3 showing the cutter having a different blade profile.
Figure 3D:
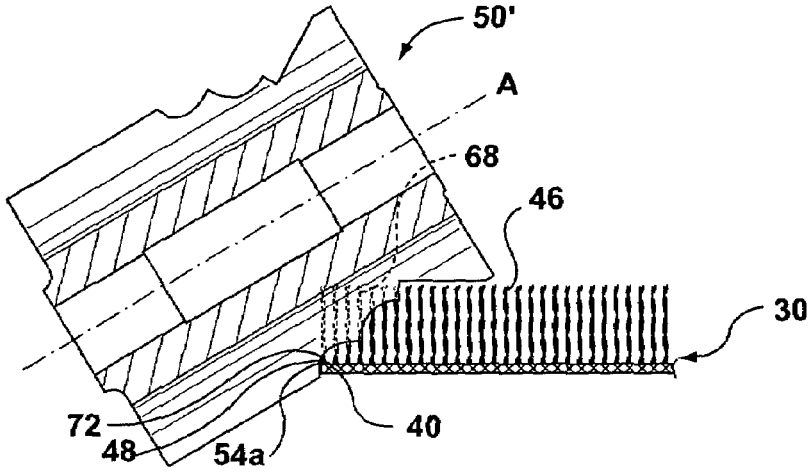
FIG. 3D shows a further alternative embodiment of the cutter of FIG. 3 showing the cutter having a different blade profile.
Figure 3E:
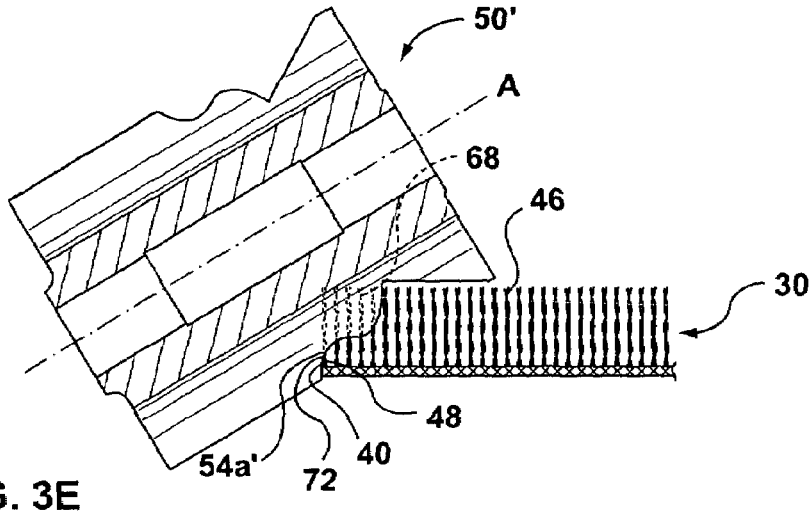
FIG. 3E shows a further alternative embodiment of the cutter of FIG. 3 showing the cutter having a different blade profile.
Figure 3F:
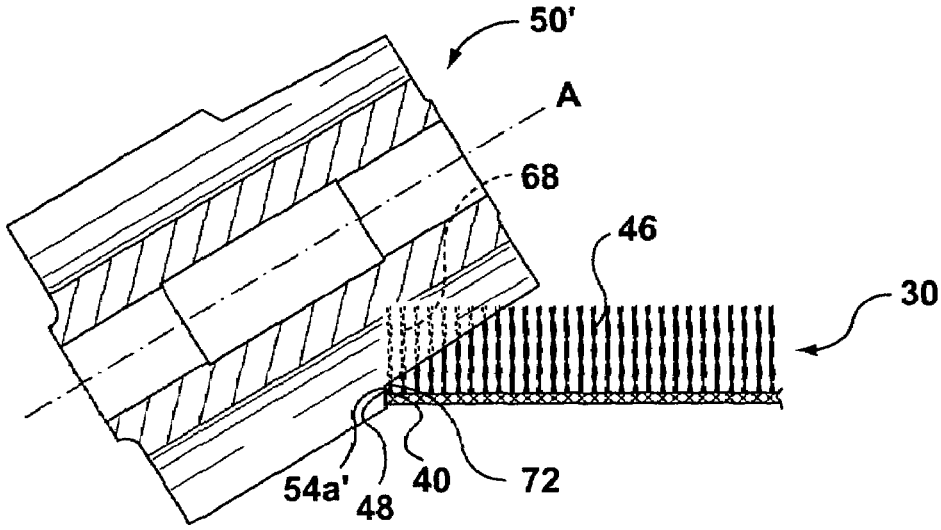
FIG. 3F shows a further alternative embodiment of the cutter of FIG. 3 showing the cutter having a clean cut portion and an adjacent linear bevel portion.
Figure 3G:
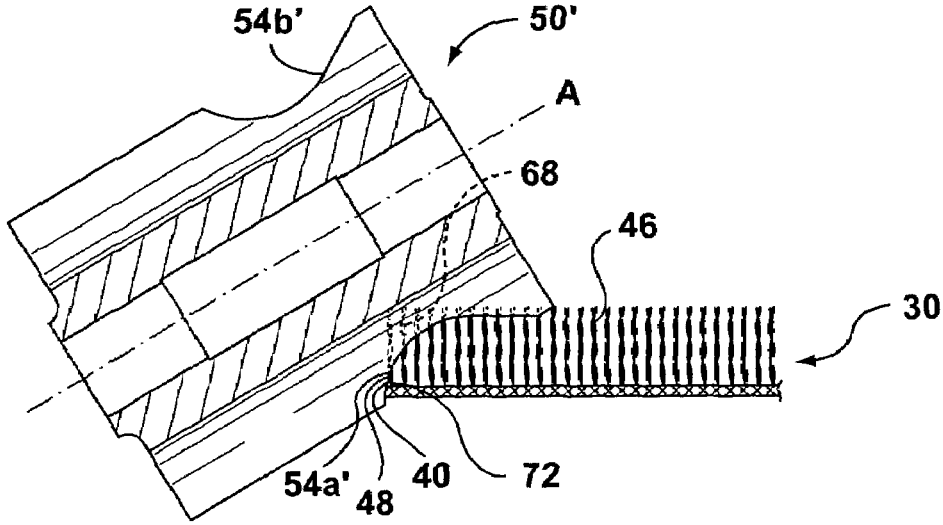
FIG. 3G shows a further alternative embodiment of the cutter of FIG. 3 showing the cutter having a different blade profile.

Referring to FIG. 3B, in an alternative embodiment of cutter 50, labelled 50', bevel portion 54*b'* includes several curves to create a different bevelling effect in carpet 30. It should be appreciated that the embodiments of the invention described herein are not limited to a particular set of cutting edges, and are generally not limited to a particular shape for bevelled portion 54*b*. Other configurations of cutting edge 54 may be used to cut bevels having curved, radiused, cusped or other non-linear shapes as shown in FIG. 3B. Alternatively, cutting edge 54 may be configured to cut a bevel having a profile made up of a combination of one or more straight sections and curved sections, or just straight or curved sections alone.

Further examples of possible bevels are shown in FIGS. 3C to 3H. As noted, changing the relative orientation of carpet 30 to cutter 50 can also be used to alter the location and extent of any bevel 70 made to carpet edge 40.

Figure 4:
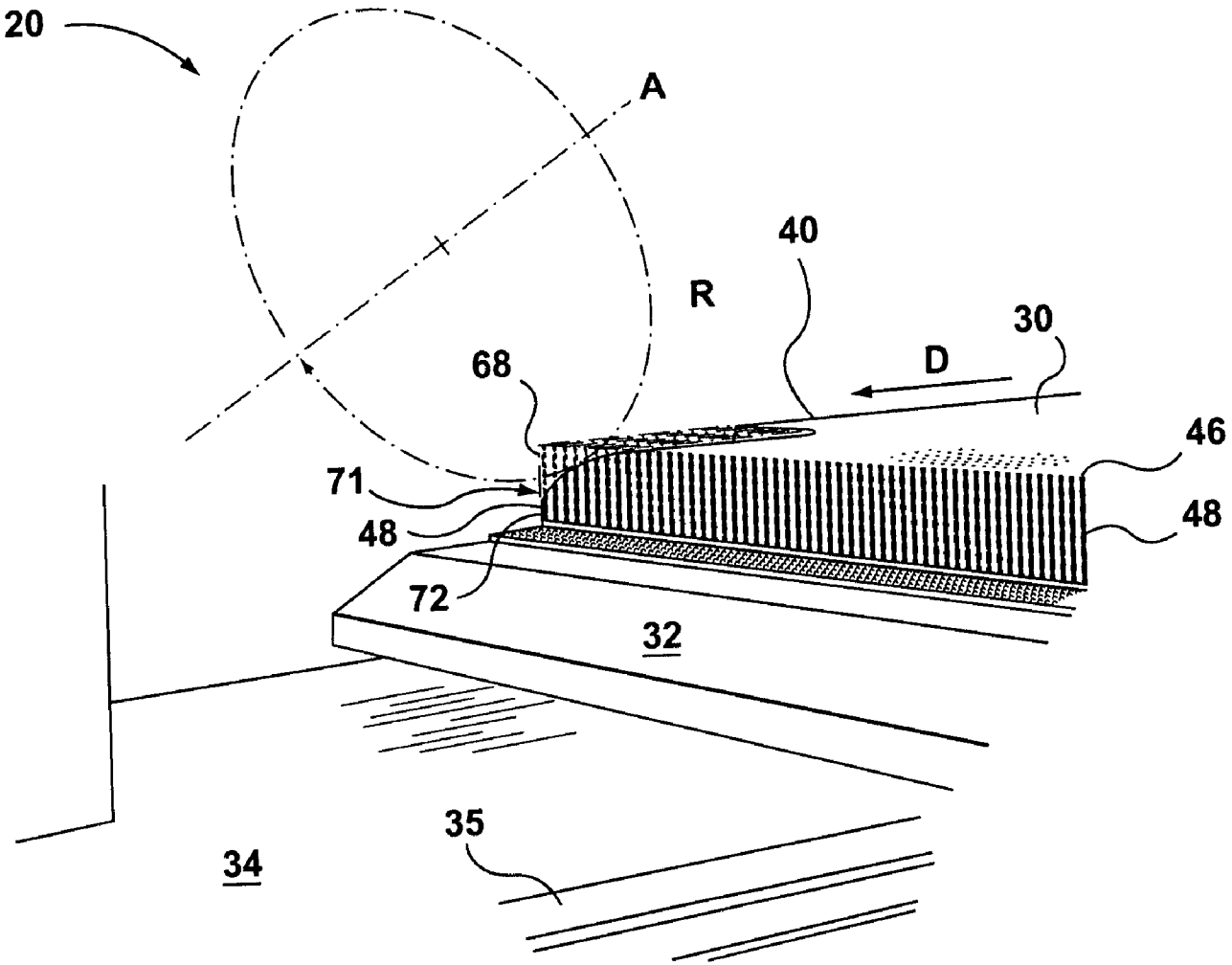
FIG. 4 is a perspective view of a carpet portion cut with the assembly of FIG. 1.

Referring to FIG. 4, carpet piece 30 is shown in perspective view to illustrate the removal of carpet tuft free ends 46 (as cut tufts 68). Beveller assembly 20 is represented only by blade axis A and a circle illustrating the direction of rotation R of cutter 50. As best seen in FIGS. 2 and 3, as carpet 30 is moved in direction D, carpet edge 40 encounters blade 52, which cuts tufts 68 from carpet 30. FIG. 4 shows the partial bevelling of edge 40 only. As carpet 30 is moved further in direction D, the entire length of carpet edge 40 will be bevelled. If a fully bevelled edge 40 is not desired, then a portion of edge 40 may be bevelled, for example as shown in FIG. 4.

Figure 5A:
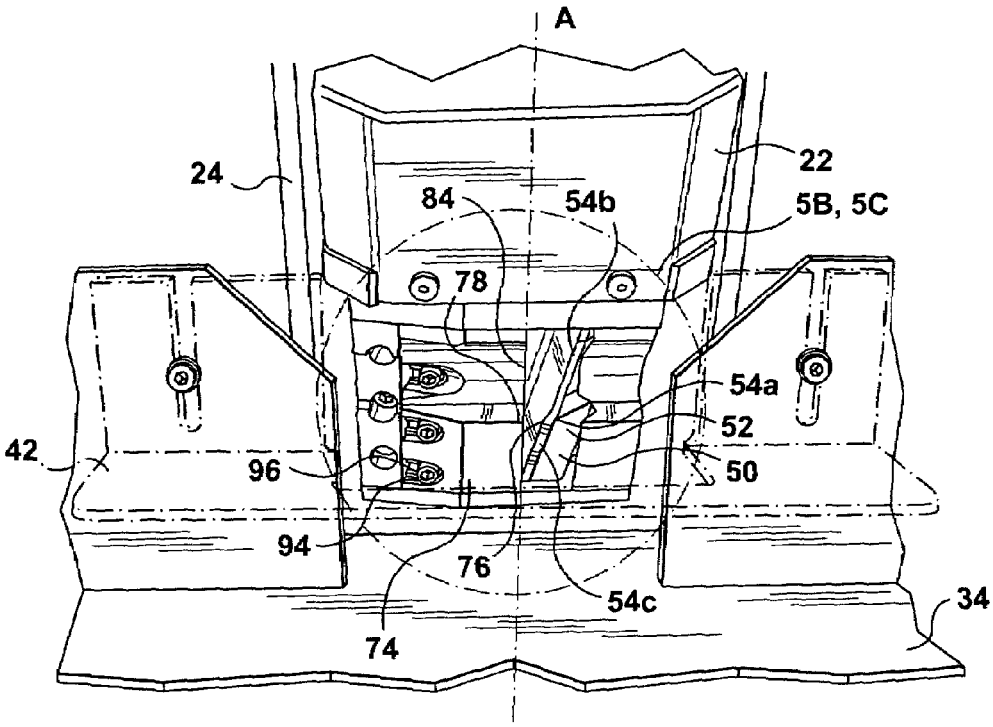
FIG. 5A shows a perspective view of the cutter of FIG. 2 and a housing therefor.
Figure 5B:
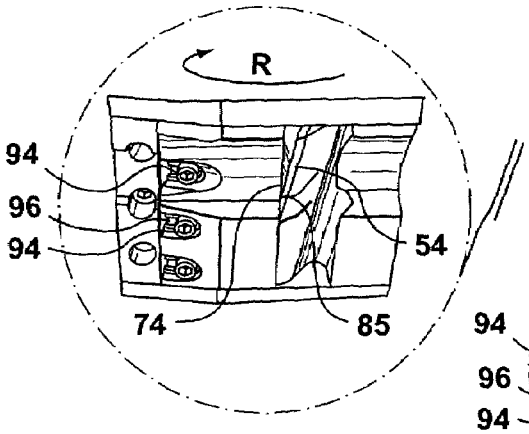
FIG. 5B shows the cutter and housing of FIG. 5A, wherein the cutter is shown rotated to a second position.
Figure 5C:
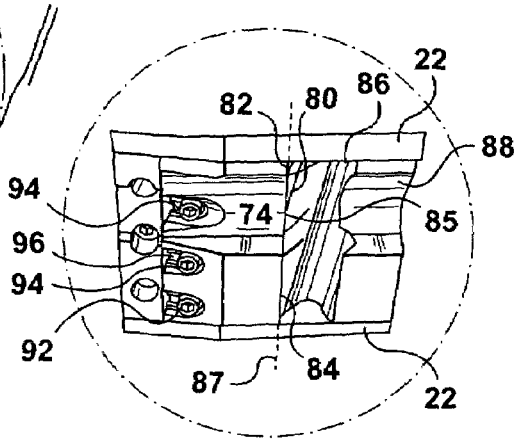
FIG. 5C shows the cutter and housing of FIG. 5B, wherein the cutter is shown rotated to a third position.

Referring to FIGS. 5A, 5B and 5C, cutter 50 is shown in detail assembled within housing 22. FIGS. 5A, 5B and 5C illustrate three discrete positions of cutter 50 as it rotates to bevel carpet piece 30. These positions are shown for illustration only. While operating, cutter 50 continuously rotates at high speed and does not stop in any particular position while cutting.

To illustrate the rotation of cutter 50, shield 42 is shown in phantom, and beveller assembly 20 is shown in a raised position to reveal cutter 50. In operation, beveller assembly 20 is pivoted towards or fixed in a position angled forwards, table 34 to cut carpet 30, as shown in FIGS. 1, 2 and 3.

Referring in particular to FIG. 5A, cutter 50 is shown having a blade 52 exposed. As described above, blade 52 has a cutting edge 54, which includes a clean cut portion 54*a*, and a bevel cutting portion 54*b*. These portions of cutting edge 54 cooperate with a similarly configured counter knife 74. Counter knife 74 is stationary and opposed to rotatable cutter 50. Counter-knife 74 has a knife edge 84 which is preferably oriented generally parallel to the cutter axis of rotation A. When knife edge 84 is oriented generally parallel to axis A, as knife edge 84 wears, sharpening and re-adjustment of knife edge 84 relative to cutting edge 54 may be somewhat easier. Alternatively, though not preferred, knife edge 84 may be skewed relative to axis A, and cutting edge 54 may be generally parallel to axis A. In the further alternative, knife edge 84 and cutting edge 54 may both be skewed or angled relative to axis A. These and other orientations of knife edge 84 and cutting edge 54 may be employed to cut material placed therebetween, as described herein.

As shown in FIG. 5A, cutting edge 54 appears skewed relative to counter-knife edge 84. When cutting edge 54 and knife edge 84 are adjacent one another, cutting edge 54 and knife edge 84 form a generally closed, or acute, angle relative to one another when viewed as in FIG. 5A. As cutter 50 rotates, cutting edge 54 passes knife edge 84 in a shearing action. Alternatively, cutting edge 54 and knife edge 84 may be generally parallel to one another so that the entire length of edges 54 and 84 are opposed to one another as cutting edge 54 passes knife edge 84 as cutter 50 rotates. This is not a preferred orientation for edges 54 and 84.

Referring to FIGS. 5A, 5B and 5C in succession, it is seen that an end 76 of the rotating cutting edge 54 is spaced from a corresponding end 78 of counter knife 74. As seen in FIG. 5B, cutting edge end 76 passes counter knife end 78 as cutter 50 further rotates. In FIG. 5C, a mid-section of cutting edge 54 passes a mid-section of counter knife 74.

As cutter 50 further rotates, the remaining end 80 of cutting edge 54 passes the remaining end 82 of knife edge 84. Cutting takes place at a point (shown for illustrative purposes in FIGS. 5B and 5C and labelled generally as 85) at which the cutting edge 54 is opposed to counter-knife edge 84. This point 85 moves from one end of knife edge 84 to the other as cutting edge 54 passes it. This moving point 85 traces a cutting line (shown for illustrative purposes in FIG. 5C as a stippled line labelled as 87) which is defined by knife edge 84. Any material such as carpet pile placed between knife edge 84 and cutting edge 54 is cut in a shearing action along cutting line 87.

As shown in FIG. 3, in the present embodiment, blades 52 are angled so that carpet tufts 48 are cut with cutting point 85 moving in a direction away from carpet base 61. Cutting in this direction is intended to discourage bunching of carpet tufts 48, which may occur if carpet tufts 48 are cut in a downward direction starting at tuft free ends 46 and moving toward carpet base 61. If carpet tufts 48 are cut from free ends 46 towards base 61, then some tufts 48 may be crushed during bevelling and an uneven bevel may result. Nevertheless, it may be possible to bevel carpet 30 in this direction by altering the orientation of blades 52.

An opening 86 is defined by knife edge 84 and portions of housing 22. The dimensions of opening 86 are set to limit the exposure of cutter 50 and other parts of beveller assembly 20. This serves to both protect cutter 50 and to reduce the chances that material not intended for cutter 50, such as an operator's finger, is introduced within housing 22.

A portion of housing 22, labelled 88, may be configured to align carpet edge 40 with counter-knife 74 and cutting edge 54 as carpet piece 30 is moved in direction D along fence 38. Housing portion 88 is preferably contoured to match a profile of both knife edge 84 and cutting edge 54. This arrangement permits a portion of carpet edge 40 to straddle opening 86 and be stabilized as it is moved past knife edge 84 and bevelled. Alternatively, housing portion 88 may be omitted.

As knife edge 84 wears, it may be adjusted by a counter-knife adjuster 92. Counter-knife adjuster 92 may include an arrangement of one or more bolts 94 and co-operating slots 96. Slots 96 are aligned in a direction generally tangent to the direction of rotation R of cutter 50. When bolts 94 are loosened, counter-knife 74 is permitted to slide in the direction of slots 96. To account for wearing of knife edge 84, counter-knife 74 may be slid to marginally narrow opening 86 to account for any knife edge material worn away during operation of beveller assembly 20. Counter-knife 74 may also be adjusted to account for marginal wearing of cutter blades 52. If counter-knife 74 becomes unusable, for example due to breakage or wear, it may be conveniently replaced by releasing counter-knife adjuster 92, removing the old counter-knife, and attaching a new counter knife to beveller assembly 20. Counter-knife 74 may also be removed for sharpening and then replaced. In the preferred embodiment, counter-knife 74 may be reground by approximately 0.1 mm along knife edge 84. Similarly, cutting edges 54 may be sharpened by regrinding of approximately 0.1 mm, and preferably by less than 0.1 mm.

A preferred material for cutter 50 is 1.3243 (S705, Böhler) HS6-5-2-5 grade steel having a hardness of 63-65 HRC. A preferred material for counter-knife 74 is 1.3343 (S600, Böhler), HS6-5-2 grade steel having a hardness of 60-62 HRC. A difference of about 3 HRC between the cutter 50 and counter-knife 74 permits the counter-knife 74 to wear before the cutter 50 does. This difference is not essential.

Referring to FIG. 6, an isolated bottom view of cutter 50 is shown. This figure further illustrates that a leading first end 76 of cutting edge 54 is followed by a trailing second end 80 of cutting edge 54, as cutter 50 rotates in direction R.

Figure 7:
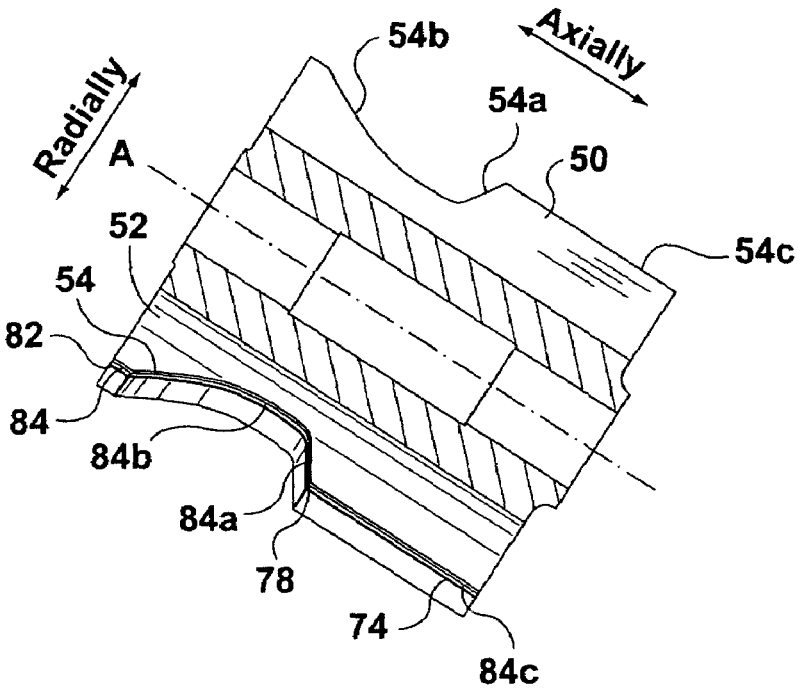
FIG. 7 shows a cross-sectional view of the cutter of FIG. 2, cut along the line 7-7 of FIG. 6.

Referring to FIG. 7, cutter 50 and a portion of counter-knife 74 are shown in isolated cross-section view to illustrate the present embodiment of the invention. Cutting blade 52 (which defines the shape of cutting edge 54) and counter-knife 74 (which defines the shape of knife edge 84) share a similar profile when viewed in cross-section. Accordingly, as cutter 50 rotates, cutting edge 54 traces a body of revolution, a side of which is generally equidistant knife edge 84.

It should be noted that the profiles of the cross-sections of blade 52 and counter-knife 74 shown in FIG. 7 are approximately equidistant from one another. However, the corresponding two edges (54 and 84) are not equidistant when viewed from a direction orthogonal to FIG. 7, as shown in FIG. 5A. For example, in FIG. 5A, cutter 50 and counter-knife 74 are shown in a view that is orthogonal to the cross-section of FIG. 7. In this view, cutting edge 54 and knife edge 84 have the appearance of being skewed relative to one another. This skewed and spaced relationship means that cutting edge 54 is rotated past knife edge 84 in succession along the edge of the cut. This reduces the energy needed for the cut. Edges 54 and 84 act together to shear material placed therebetween.

Conceptually, cutting edge 54 and knife edge 84 may be viewed as lying along the sides of inner and outer concentric cylinders having irregular, but complimentary sides. The conceptual inner cylinder has cutting edge 54 extending about an outer side thereof, and the conceptual outer cylinder has knife edge 84 extending along an inner side thereof. The inner cylinder is permitted to rotate freely due to the complimentary configuration of the outer cylinder, even though the cylinders have irregular sides. The earlier described "skewing" of the knife blade can be conceived as the knife blade sitting on the surface of the inner-concentric cylinder, as, for example, in a helix, but any configuration along the surface of an imaginary cylinder could work. Furthermore, points along the edge of the knife blade may be differentially radially spaced from the axis of rotation A. This is a conceptual example only. Neither cutting edge 54 nor knife edge 84 are defined by actual cylinders. They could also be thought of as simply "bodies of rotation".

Referring again to FIG. 7, the cross-sectional profiles of cutting blade 52 and counter-knife 74 are substantially the same distance apart at the cutting point 85 (i.e., the effective intersection of cutting edge 54 and knife edge 84, described above). Cutting point 85 moves from one end 78 of counter-knife 74 to the other end 82, as cutting edge 54 is rotated past knife edge 84. The uniform spacing of cutting edge 54 and knife edge 84 at cutting point 85 helps to create a uniformly cut bevel in carpet 30. If cutting edge 54 and knife edge 84 are too far apart then material placed therebetween might not shear, and instead might become lodged between the two edges 54 and 84. If cutting edge 54 and knife edge 84 are not uniformly spaced as cutting point 85 moves along cutting line 87, then a bevel of varying quality may result. Cutting edge 54 and knife edge 84 are preferably spaced at cutting point 85 by an minimal distance. For example, cutting edge 54 and knife edge 84 may be spaced by one tenth of the diameter of a carpet tuft 48. The cutting edge 54 and knife edge 84 may be so close to one another that they are touching but with essentially no pressure exerted therebetween. Other spacings may be employed depending on the sharpness of the respective edges 54 and 84. In the preferred embodiment, wearing of knife edge 84 by one or two hundredths of a millimetre will generally have a limited negative effect on cutting.

When blades 52 and counter-knife 74 are configured to have non-linear profiles, cutter 50 is aligned along three dimensions in relation to counter-knife 74. In a first dimension, blade 52 is aligned axially with counter-knife 74 relative to axis of rotation A. This permits the contours of the respective profiles of blade 52 and counter-knife 74 to be radially opposed to one another. In a second dimension, blade 52 is uniformly spaced radially from counter-knife 74 relative to axis of rotation A (as described above). Finally, in a third dimension, cutter 50 is oriented so that knife edge 84 is positioned on a tangent to the arc defined by cutting edge 54 when it rotates. Put another way, blade 52 and counter-knife 74 are precisely oriented in the axial, radial and the tangential dimensions. In the case of FIG. 7, the tangential dimension is normal to the plane of the page. In contrast, prior art bevellers typically have linear cutting edges and therefore tend to be aligned with a corresponding counter knife radially and tangentially only. In the prior art, the cutting blade and counter-knife of known straight-edge bevellers may be moved up and down axially a small distance without significantly affecting the linear bevel cut.

When counter-knife 74 is adjusted or sharpened (or if cutter 50 is adjusted or sharpened), careful adjustment of counter-knife 74 and cutter 50 should preferably be made to ensure proper relative alignment in three dimensions, as described above.

Since counter-knife edge 84 has a similar profile to cutting edge 54, knife edge 84 also has in this embodiment at least the following portions: a clean cut portion 84*a*, and a bevel cutting portion 84*b*. This complementary configuration of cutter 50 and counter-knife 74 permits beveller assembly 20 to make both multiple types of cuts in one pass of beveller assembly 20 along carpet edge 40, and permits beveller assembly 20 to create bevels having a non-linear profile.

In operation, multiple cuts are made concurrently by beveller assembly 20 in a single pass, as follows. Co-operating portions 54*a* and 84*a* of opposed edges 54 and 84 clean edge 40 of carpet 30. At substantially the same time, a buffer zone 71 is created by co-operating edge portions 54*a* and 54*b*, and 84*a* and 84*b*. Similarly, a bevel is cut by co-operating edge portions 54*b* and 84*b*. These three portions of carpet piece 30, the edge, the buffer zone, and the bevel, are effectively cut at the same time due to the high rate of rotation of the cutter 50 relative to counter-knife 74 (each portion is actually cut sequentially, a fraction of a second apart).

In other embodiments of the invention, the dimensions and configuration of the respective portions 54*a* and 84*a*, and 54*b* and 84*b* may be varied to create cuts and bevels of different shapes, examples of which are illustrated in FIGS. 3A to 3H. Corresponding portions 54*a* and 54*b*, and portions 84*a* and 84*b* have similar and uniformly spaced cross-sectional profiles to enable generally uniform bevelling of carpet piece 30. Note, for example in FIG. 3C, that at least bevel cutting portion 54*b* may extend beyond the surface of a notional cylinder generally defined by the rotating peripheral edges of cutter 50.

In the embodiments described, there are portions of cutting edge 54 and knife edge 84 which are not used to cut carpet. In particular, cutting edge portion 54*c* (best seen in FIGS. 5A and 7) and knife edge portion 84*c* (best seen in FIG. 7) permit cut tuft ends 68, and other material, to be directed away from the cutting area, but these portions do not necessarily cut carpet 30. In other embodiments, these edge portions 54*c* and 84*c* may be configured and used to bevel carpets either in conjunction with the other portions of the cutting edge 54 and knife edge 84, or alone.

Beveller assembly 20 may be used to bevel most types of carpet, including commercially available carpet pieces. However, the extent to which a carpet piece may be bevelled often depends on the depth of the carpet pile. A deeper pile provides more carpet material to be cut. For example, carpets having one-quarter inch, half inch or one inch piles may be bevelled. As will be well known by one skilled in the art, the physical characteristics of some types of carpet may make them difficult to bevel. For example, if the tufts of a carpet do not have sufficient density and/or stiffness, then the tufts may become misaligned after cutting, distorting the bevelled edge of the carpet. Nevertheless, many carpet types, even those having less than ideal characteristics, may be bevelled, at least to some extent.

Numerous modifications, variations, and adaptations may be made to the particular embodiments of the invention described above without departing from the scope of the invention, which is defined in the following claims.

What is claimed is:

1. A beveller for a carpet, the beveller comprising:

a rotatable blade for cutting material, the blade being mounted about an axis of rotation and having an edge which is non-linear radially;

a stationary counter-knife having an edge mounted adjacent to the blade;

a material support surface adjacent the counter-knife for supporting the carpet, wherein the surface and counter-knife edge are not co-planar; and wherein the counter-knife edge generally conforms to a profile of the blade edge to permit the blade edge to pass adjacent the counter-knife edge, as the blade rotates, to shear material placed between the blade edge and the counter-knife edge; and the blade edge is located along an imaginary cylindrical surface formed by the rotation of the cutting edge, so that the cutting edge of the rotating blade passes the cutting edge of the counter-knife in succession when the rotating blade is turned; and wherein the material support surface is movable relative to the blade or counter-knife generally along a tangent of the cylindrical surface.

2. The beveller of claim 1, wherein the counter-knife edge and blade edge form an acute cutting angle there between when the blade is rotated relative to the counter-knife, the apex of the acute cutting angle moving along the counter-knife edge as the blade is rotated to shear material placed adjacent the apex.

3. The beveller of claim 1, wherein a portion of the blade edge first rotates past the counter-knife to cut a portion of the carpet pile adjacent a base of the carpet first.

4. The beveller of claim 1, wherein the counter-knife edge is parallel to the axis of rotation.

5. The beveller of claim 1, wherein the blade edge has at least one curved portion.

6. The beveller of claim 1, the blade edge further comprising a portion for cleaning an edge of the carpet and the counter-knife further comprising an edge that generally conforms to a profile of the cleaning portion of the blade edge.

7. The beveller of claim 1, wherein the blade edge has at least one straight portion.

8. The beveller of claim 1, wherein the blade edge has at least one cusped portion.

9. The beveller of claim 1, wherein at least one of the surface and the counter-knife are movable relative to the other.

10. A beveller for a carpet comprising:

(a) a rotatable blade having a cutting edge moveable about a first axis of rotation, the cutting edge being differentially radially spaced from the axis of rotation and tracing as it rotates a cutting boundary radially spaced from the axis of rotation;

(b) a counter-knife having a cutting edge conforming radially to the shape of the rotating blade and placed so as to come into adjacent cutting relation at a point or points equidistant from the cutting boundary traced by the rotating blade;

(c) a material support surface adjacent the counter-knife for supporting the carpet, wherein the surface and counter-knife edge are not co-planar; and (d) the material support surface is moveable relative to the blade or counter-knife generally along a tangent of the cutting boundary; and wherein the counter-knife and rotatable blade come into cutting relation sequentially axially as the rotatable blade traces the cutting boundary.

11. The beveller in claim 10 wherein the counter-knife and the cutting edge of the rotatable blade are oriented in respect of a carpet edge so that they come into cutting relation to cut the carpet edge at a point sequentially from a base of the carpet to free ends of tuffs of the carpet.

12. The beveller in claim 10 wherein the blade is shaped so that it traces a cutting boundary which cuts a first portion which is substantially perpendicular to the plane of the carpet base and a second portion which is at an angle relative to the plane of the carpet base.

13. The beveller of claim 10, wherein at least one of the surface and the counter-knife are movable relative to the other.

* * * * *